US008240832B2

(12) United States Patent
Anno et al.

(10) Patent No.: US 8,240,832 B2
(45) Date of Patent: Aug. 14, 2012

(54) HEAD UNIT AND PRINTER

(75) Inventors: Motoyuki Anno, Kyoto (JP); Kazutaka Tasaka, Kyoto (JP); Jindra Vosahlo, Theneuille (FR)

(73) Assignee: Dainippon Screen Mfg. Co., Ltd., Kyoto-Shi, Kyoto (JP)

( * ) Notice: Subject to any disclaimer, the term of this patent is extended or adjusted under 35 U.S.C. 154(b) by 396 days.

(21) Appl. No.: 12/472,226

(22) Filed: May 26, 2009

(65) Prior Publication Data

US 2009/0295889 A1 Dec. 3, 2009

(30) Foreign Application Priority Data

May 27, 2008 (JP) ..... P2008-137483

(51) Int. Cl.
*B41J 2/18* (2006.01)

(52) U.S. Cl. ..... 347/89

(58) Field of Classification Search ..... None
See application file for complete search history.

(56) References Cited

U.S. PATENT DOCUMENTS

| | | | | |
|---|---|---|---|---|
| 5,771,052 | A | 6/1998 | Hine et al. | 347/42 |
| 2002/0118256 | A1 | 8/2002 | Dixon et al. | 347/65 |
| 2007/0252860 | A1 | 11/2007 | Nitta et al. | |
| 2008/0158307 | A1* | 7/2008 | Nitta et al. | 347/85 |
| 2008/0158320 | A1* | 7/2008 | Nitta et al. | 347/89 |

FOREIGN PATENT DOCUMENTS

| | | | |
|---|---|---|---|
| JP | P2000-507522 | A | 6/2000 |
| JP | P2002-533247 | A | 10/2002 |
| JP | 2005081546 | | 3/2005 |
| JP | P2007-90686 | A | 4/2007 |
| JP | 2007313884 | | 12/2007 |
| JP | 2008000962 | | 1/2008 |

* cited by examiner

*Primary Examiner* — Matthew Luu
*Assistant Examiner* — Erica Lin
(74) *Attorney, Agent, or Firm* — Dorsey & Whitney LLP

(57) ABSTRACT

A head unit has a supply tank provided above a plurality of heads, for storing ink and a collecting part having an internal space into which ink flows from the plurality of heads. In the head unit, a plurality of ink inlet pipes serving as a plurality of passages leading from the supply tank to the plurality of heads have the same shape and the same resistance and a plurality of ink outlet pipes serving as a plurality of passages from the plurality of heads to the collecting part have the same shape and the same resistance. This equalizes respective flow rates of ink and respective pressures of ink at nozzles in the plurality of heads. As a result, it is possible to suppress variation in landing positions and the like of ink with respect to the nozzles among the plurality of heads.

6 Claims, 7 Drawing Sheets

HEAD UNIT AND PRINTER

FIELD OF THE INVENTION

The present invention relates to a head unit to which ink is supplied from a storage tank and from which ink thereinside is returned to the storage tank and a printer which has the head unit.

DESCRIPTION OF THE BACKGROUND ART

Inkjet printers have been conventionally used to each print on a printing medium by scanning the printing medium with its head in which a plurality of nozzles for ejecting fine droplets of ink are arranged. Also well known are printers each of which prints while circulating ink between an ink tank storing ink and a head. In a printing apparatus shown in International Publication No. WO 98/19864, for example, circulation of ink is performed where ink is fed by a pump from an ink bottle storing ink to a print head in which a plurality of inkjet modules are arranged and the ink is returned from the print head to the ink bottle through another return line. In a printing apparatus shown in International Publication No. WO 00/38928, circulation of ink is performed where ink is supplied from a lower container positioned below a print head, being open to the air, to an upper container positioned above the print head, being open to the air, by a pump and the ink is returned from the upper container to the lower container through the print head.

In a printing apparatus in which circulation of ink is performed, even if air bubbles appear in the ink in a head (in a piezoelectric driving type head, for example, oscillation caused by high-speed driving of piezoelectricity sometimes causes air bubbles in ink), it is possible to return the air bubbles together with the ink to an ink tank and this suppresses the occurrence of a state where air bubbles move to nozzles of the head to temporarily block ejection of ink from the nozzles (the occurrence of the so-called missing nozzle). Further, circulation of ink can also resolve the precipitation of pigment which often occurs when white ink is used, and the like.

In a case where a plurality of heads are provided in the printing apparatus in which circulation of ink is performed, when respective pressures at nozzles in the plurality of heads are different, this causes landing positions on a printing medium and the like of ink with respect to the nozzles (i.e., relative landing positions of fine droplets of ink on the printing medium with respect to the positions of the nozzles in ejection of the fine droplets) to vary.

SUMMARY OF THE INVENTION

The present invention is intended for a head unit to which ink is supplied from a storage tank and from which ink thereinside is returned to the storage tank in an inkjet printer, and it is an object of the present invention to suppress variation (difference) in landing positions and the like of ink with respect to nozzles among a plurality of heads.

According to the present invention, the head unit comprises a plurality of heads each having a plurality of nozzles arranged in an arrangement direction, for ejecting fine droplets of ink from the plurality of nozzles, a supply tank storing ink above the plurality of heads, an ink inlet part for running ink into the plurality of heads from the supply tank, a collecting part having an internal space into which ink flows from the plurality of heads, and an ink outlet part connecting the plurality of heads and the collecting part, and in the head unit of the present invention, a plurality of passages leading from the supply tank to the plurality of heads have the same shape in the ink inlet part, and a plurality of passages leading from the plurality of heads to the collecting part have the same shape in the ink outlet part.

In the present invention, by equalizing respective resistances of the plurality of passages leading from the supply tank to the plurality of heads and also equalizing respective resistances of the plurality of passages leading from the plurality of heads to the collecting part, the flow rates of ink in the plurality of heads can be equalized and the pressures of ink at the nozzles in the plurality of heads can be equalized. As a result, it is possible to suppress variation (difference) in landing positions and the like of ink with respect to the nozzles among the plurality of heads.

According to one preferred embodiment of the present invention, the ink inlet part has a plurality of ink inlet pipes extending straight downwardly from the supply tank, with the same length and the same passage diameter, to be connected to the plurality of heads, respectively. It is thereby possible to reduce passage resistances between the supply tank and the plurality of heads. More preferably, the ink outlet part has a plurality of ink outlet pipes extending straight downwardly from the collecting part, with the same length and the same passage diameter, to be connected to the plurality of heads, respectively, and the collecting part is positioned between the plurality of heads and the supply tank and has such a shape as to avoid interference with the plurality of ink inlet pipes or the supply tank is positioned between the plurality of heads and the collecting part and has such a shape as to avoid interference with the plurality of ink outlet pipes. It is also thereby possible to reduce passage resistances between the plurality of heads and the collecting part.

According to another preferred embodiment of the present invention, the head unit further comprises a fixing member having a thin plate which is elongated in the arrangement direction and parallel to a vertical direction and has main surfaces on both of which the plurality of heads are fixed alternately along the arrangement direction, and in the head unit of the present invention, the fixing member is attached onto one of the supply tank and the collecting part, which is provided under the other. With this construction, it is possible to prevent the interval between heads in a direction orthogonal to the arrangement direction and the vertical direction to become excessively large and to firmly support the plurality of heads which are arranged in a staggered manner.

The present invention is also intended for an inkjet printer. According to the present invention, the printer comprises a head unit, and an ink circulation mechanism for supplying ink to the head unit from a storage tank and returning ink to the storage tank from the head unit, and in the printer of the present invention, the head unit comprises a plurality of heads each having a plurality of nozzles arranged in an arrangement direction, for ejecting fine droplets of ink from the plurality of nozzles, a supply tank supplied with ink from the storage tank and storing ink above the plurality of heads, an ink inlet part for running ink into the plurality of heads from the supply tank, a collecting part having an internal space into which ink flows from the plurality of heads and from which ink thereinside is returned to the storage tank, and an ink outlet part connecting the plurality of heads and the collecting part, and in the ink inlet part, a plurality of passages leading from the supply tank to the plurality of heads have the same shape, and in the ink outlet part, a plurality of passages leading from the plurality of heads to the collecting part have the same shape. This suppresses variation in the landing positions and the like of ink with respect to the nozzles among the plurality of heads, and it is thereby possible to achieve printing of an image with high precision.

Preferably, the ink circulation mechanism comprises a pump provided in a supply line for ink leading from the storage tank to the head unit, for supplying the supply tank with ink stored in the storage tank, and a decompressor for decompressing the inside of the storage tank, to return ink from the supply tank to the storage tank through a passage which leads from the supply tank to the storage tank via the plurality of heads, with the passage filled with ink. It is thereby possible to appropriately circulate ink while degassing ink in the storage tank by using a negative pressure in the storage tank.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
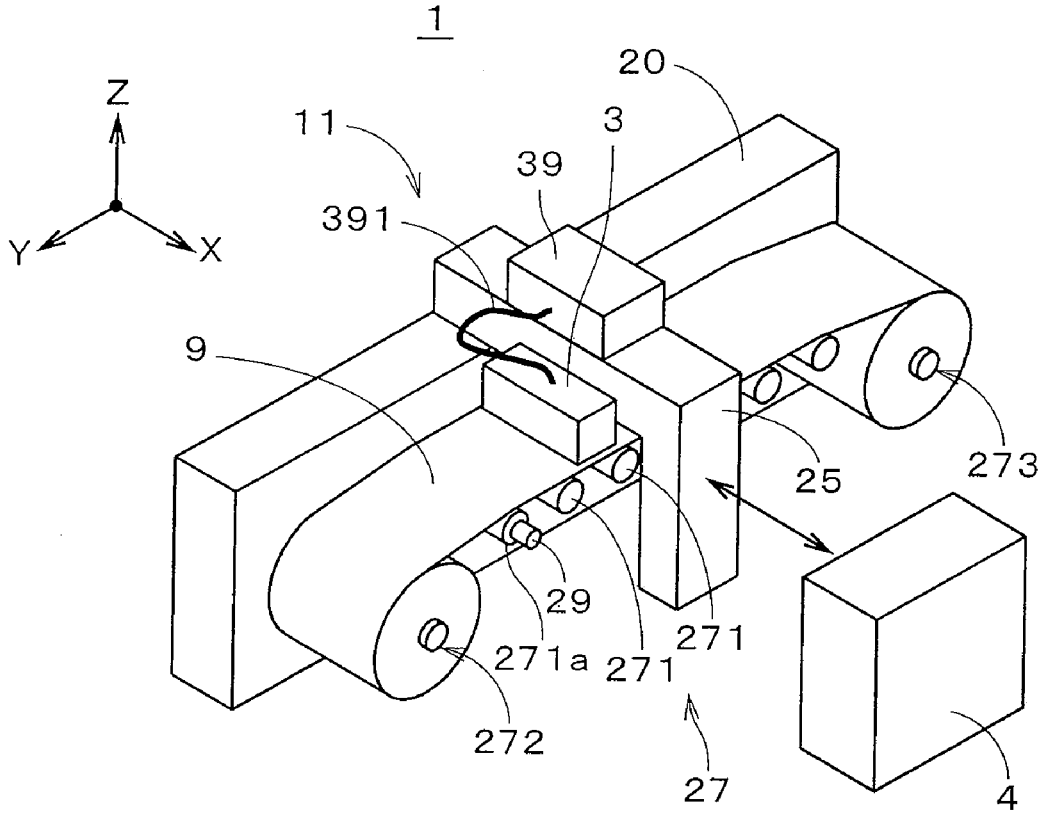
FIG. 1 is a perspective view showing an appearance of a printer.

FIG. 1 is a perspective view showing an appearance of a printer 1. The printer 1 performs color printing on a sheet-like liquid-repellent base material 9 such as film in an inkjet manner.

The printer 1 of FIG. 1 comprises a main body 11 and a control part 4, and the main body 11 comprises a feeder 27 for moving the sheet-like base material 9 in the Y direction (hereinafter, referred to also as "scan direction") of FIG. 1 and an ejection part 3 for ejecting fine droplets of ink onto the base material 9 while the base material 9 is being moved by the feeder 27. In the feeder 27, a plurality of rollers 271 each of which is long in the X direction of FIG. 1 are arranged in the Y direction, and on the (+Y) side of the plurality of rollers 271, a supplying part 272 for holding a roll-like base material 9 (feed roll) is provided and on the (−Y) side of the plurality of rollers 271, a winding part 273 for holding a roll-like base material 9 (wind-up roll) is provided. In the following discussion, when simply referred to as the base material 9, it refers to a part of the base material 9 which is being moved (in other words, a part of the base material 9 which is positioned on the plurality of rollers 271).

One of the rollers, 271*a*, in the feeder 27 is provided with an encoder 29 for detecting a movement speed of the base material 9 in the scan direction, and the control part 4 controls the rotation of a motor of the winding part 273 on the basis of an output of the encoder 29, to thereby move the base material 9 in the (−Y) direction at a constant speed. Actually, a motor of the supplying part 272 gives a load (tension) in a direction opposite to a moving direction (i.e., in the (+Y) direction) to the base material 9, to thereby smoothly move the base material 9 on the plurality of rollers 271 without waving.

The ejection part 3 is disposed above the plurality of rollers 271 (on the (+Z) side of FIG. 1) and fixed onto a frame 25 provided on a base 20, being across the plurality of rollers 271. On the frame 25, a light source 39 for emitting ultraviolet rays is provided and light emitted from the light source 39 is led into the ejection part 3 through a plurality of optical fibers (actually, the plurality of optical fibers are made into a bundle and indicated by one thick line with reference numeral 391 in FIG. 1).

Figure 2:
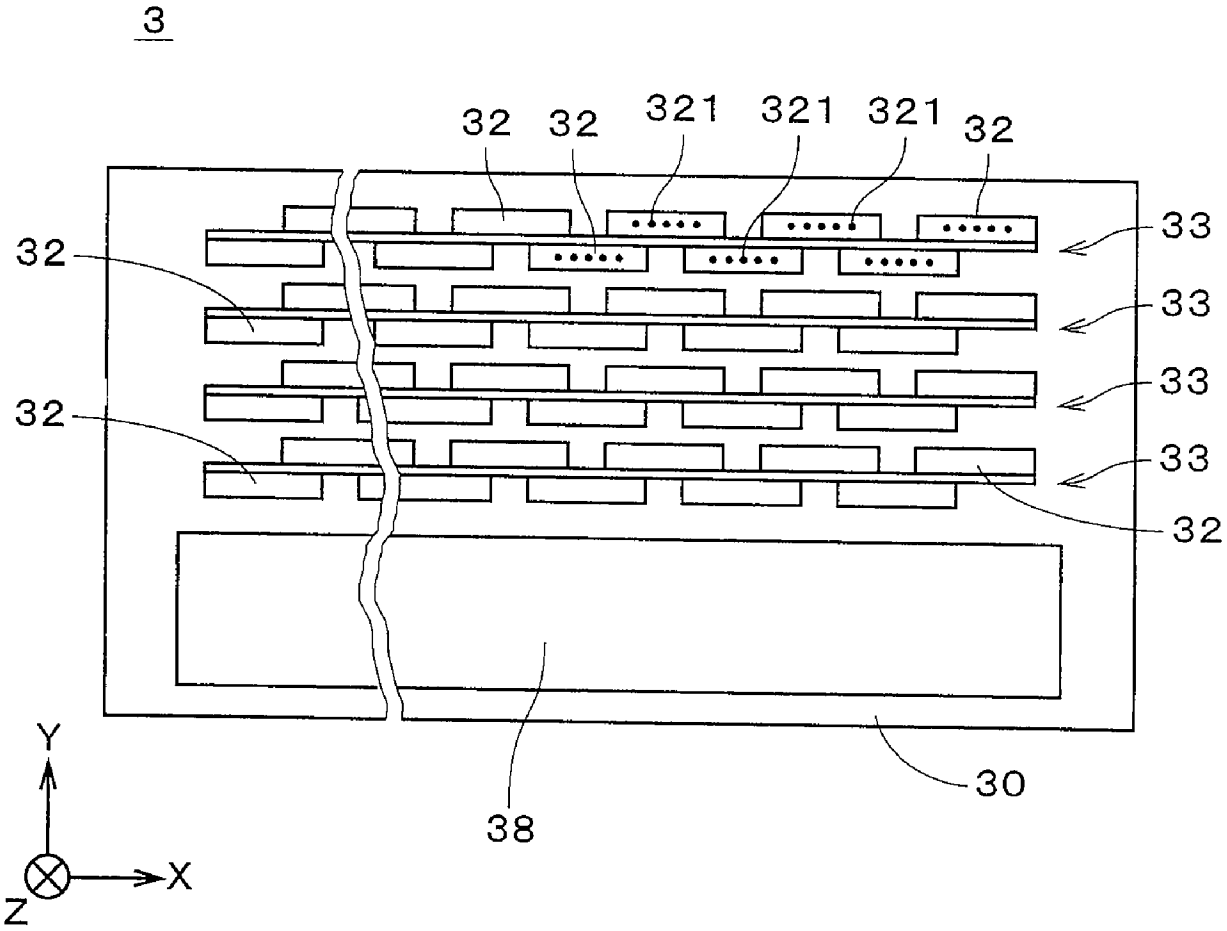
FIG. 2 is a bottom plan view showing an ejection part.

FIG. 2 is a bottom plan view showing the ejection part 3. As shown in FIG. 2, the ejection part 3 comprises a plurality of head units 33 (four head units 33 in FIG. 2) for ejecting ink of different colors, and the plurality of head units 33 are arranged in the Y direction and fixed to a body 30 of the ejection part 3. In FIG. 2, the first head unit 33 on the (+Y) side ejects ink of K (black), the head unit 33 adjacent to the head unit 33 of K on the (−Y) side ejects ink of C (cyan), the head unit 33 adjacent to the head unit 33 of C on the (−Y) side ejects ink of M (magenta) and the first head unit 33 on the (−Y) side ejects ink of Y (yellow). The ink of each color includes an ultraviolet curing agent and is ultraviolet curable. The ejection part 3 may be further provided with head units 33 of other colors, e.g., light cyan, light magenta, white and the like.

In each of the head unit 33, the plurality of heads 32 of e.g., piezoelectric driving type are arranged in a staggered manner in the X direction (a direction orthogonal to the Y direction and the Z direction, and hereinafter, referred to as a "width direction") in FIG. 2, and in a lower surface (a surface on the (−Z) side) of each head 32, the plurality of nozzles (which are openings for ejecting ink, the nozzles in some heads 32 are represented by dots with reference numeral 321) are formed and arranged in the width direction. In the head units 33, on the whole, a lot of nozzles 321 are arranged at a constant pitch in the width direction which is an arrangement direction, to thereby allow formation of a plurality of dots aligned in the width direction at each position on the base material 9 in the scan direction. Actually, the plurality of nozzles 321 in each of the head units 33 are provided entirely in a printing area on the base material 9 with respect to the width direction (herein, almost entirely in the width in the width direction of the base material 9), and with only one pass of the base material 9 below the ejection part 3, printing of an image on the base material 9 is completed (so-called one-pass printing).

In the ejection part 3 of FIG. 2, a light emitting part 38 connected to the light source 39 is provided on the (−Y) side of the plurality of head units 33. In the light emitting part 38, a plurality of optical fibers are arranged along the X direction and ultraviolet rays are emitted from the light emitting part 38 onto a linear area extending in the X direction on the base material 9.

In the printer 1, each of the head units 33 are connected to the ink circulation mechanism 5 (see FIG. 3 discussed later), and with the ink circulation mechanism 5, ink is supplied to the head unit 33 and returned from the head unit 33. In the following discussion, though attention is paid to the head units 33 for one color out of the plurality of colors and the ink circulation mechanism 5 for the one color, the same applies to the head units and the ink circulation mechanisms of other colors.

Figure 3:
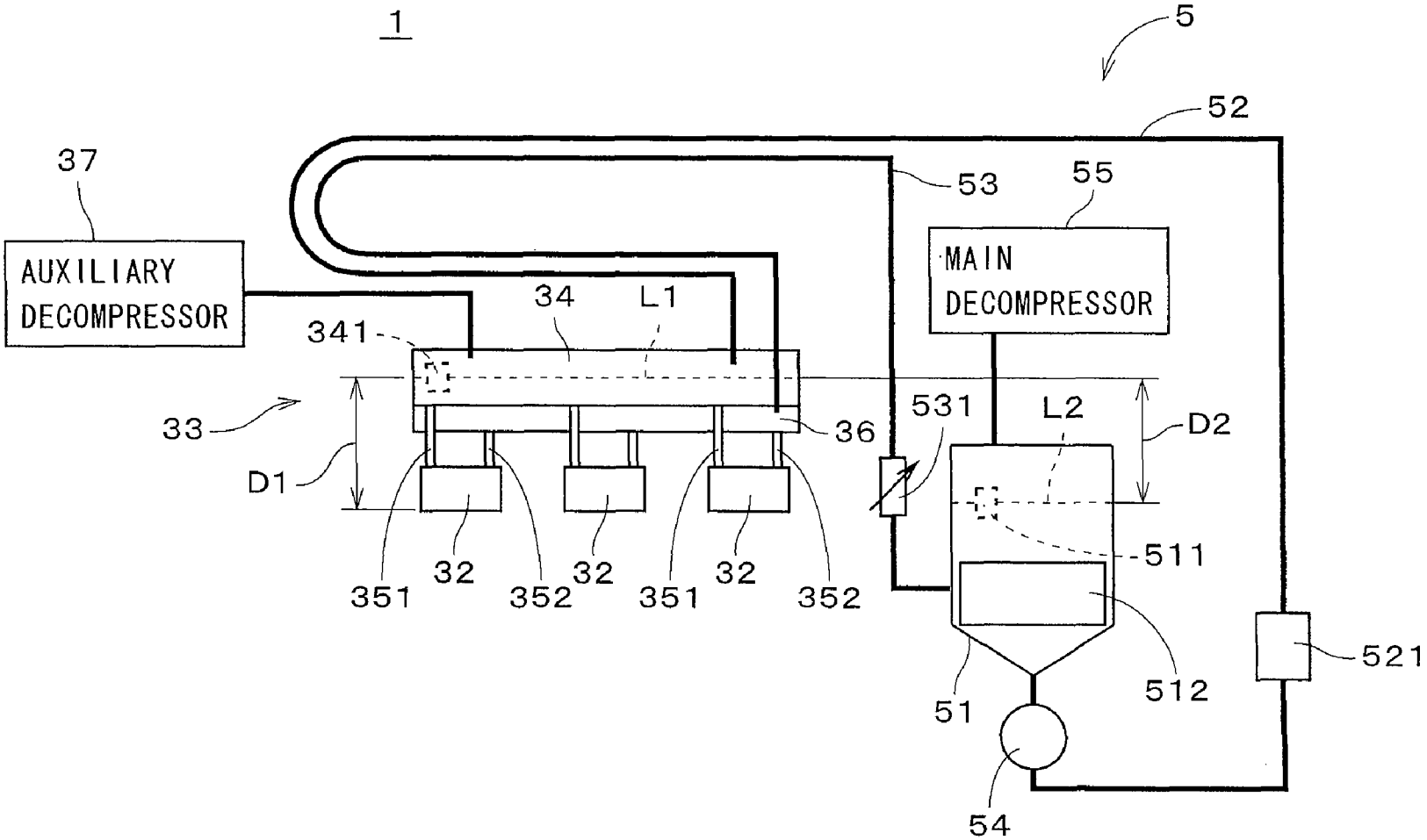
FIG. 3 is a view showing a construction of an ink circulation mechanism.

FIG. 3 is a view showing a construction of the head unit 33 and the ink circulation mechanism 5. Though FIG. 3 shows three heads 32, an actual head unit 33 is provided with a lot of heads 32 as shown in FIG. 2.

As shown in FIG. 3, the head unit 33 comprises a supply tank 34 storing ink above and in the vicinity of the plurality of heads 32, a plurality of ink inlet pipes 351 serving as an ink inlet part for causing flow of ink from the supply tank 34 to the plurality of heads 32, respectively, a collecting part 36 provided in two tiered structure with the supply tank 34 above the plurality of heads 32, having an internal space into which ink flows from the plurality of heads 32 and a plurality of ink outlet pipes 352 connecting the plurality of heads 32 and the collecting part 36, respectively, and serving as an ink outlet part for causing ink in the plurality of heads 32 to flow into the collecting part 36. Detailed construction of the head unit 33 will be discussed later.

The ink circulation mechanism 5 comprises a storage tank 51 storing ink, and the storage tank 51 is connected to the supply tank 34 in the head unit 33 through a supply line 52 and also connected to the plurality of heads 32 through a return line 53, the collecting part 36 in the head unit 33 and the plurality of ink outlet pipes 352. The supply line 52 is provided with a pump 54 and a filter 521, and with the pump 54, ink stored in the storage tank 51 is supplied to the supply tank 34 and stored therein while unnecessary substances in the ink are removed through the filter 521. The area of cross section in a horizontal plane of the internal space in the storage tank 51 is almost constant in a vertical direction (the same applies to the supply tank 34), and the cross-sectional area of the storage tank 51 is larger than that of the supply tank 34.

To the storage tank 51, a main decompressor 55 having a pump, a pressure regulating valve, a pressure gauge and the like is connected, and the main decompressor 55 reduces a pressure (of gas) inside the storage tank 51 to become a pressure lower than the atmosphere pressure by several hundred millibar (mbar) (e.g., 500 mbar (i.e., $5\times10^4$ pascal (Pa))), to thereby return ink from the supply tank 34 to the storage tank 51 through a passage leading from the supply tank 34 to the storage tank 51 via the plurality of ink inlet pipes 351, the plurality of heads 32, the plurality of ink outlet pipes 352, the collecting part 36 and the return line 53, with the passage filled with ink.

The return line 53 is provided with a flow regulating valve 531 serving as a flow limiting part to limit the flow of ink from the supply tank 34 to the storage tank 51 in accordance with the area of an opening serving as a passage inside the flow regulating valve 531. In a normal operation of the preferred embodiment, since the area of the passage opening inside the flow regulating valve 531 is not changed, the flow rate of ink from the supply tank 34 to the storage tank 51 mainly depends on the pressure inside the storage tank 51 (exactly, the difference in pressure between the supply tank 34 and the storage tank 51). In the ink circulation mechanism 5, since the main decompressor 55 controls the pressure inside the storage tank 51 to be almost constant, the flow rate of ink in the heads 32 is made almost constant with time. Further, depending on the design of the printer 1, a thin tube capable of causing the same pressure loss as the flow regulating valve 531 does may be provided as the flow limiting part instead of flow regulating valve 531.

Though the flow rate of ink, actually, also depends on the position of a liquid surface of ink in the supply tank 34, since the specific gravity of ink used in the preferred embodiment is almost 1 and variation in the position of the liquid surface of ink is controlled to fall within the range of ±several millimeter (mm) in the printer 1, the variation in the position of the liquid surface of ink corresponds to only pressure variation less than ±1 mbar. Therefore, the effect of the variation in the position of the liquid surface of ink in the supply tank 34 on the flow rate of ink is very small, as compared with the pressure variation in the storage tank 51, enough to be ignored.

The supply tank 34 and the storage tank 51 are provided with ink level sensors 341 and 511, respectively, for each detecting the position of the liquid surface of ink (i.e., ink level). In the supply tank 34 and the storage tank 51, set are predetermined preset ink levels (indicated by broken lines L1 and L2, respectively, in FIG. 3, and the same applies to FIGS. 4 and 5 discussed later) and replenishment end levels indicating the upper limits and replenishment start levels indicating lower limits with the respective preset ink levels as center positions. In the supply tank 34, when the position of the liquid surface of ink becomes equal to or lower than the replenishment start level, ink is replenished (supplied) from the storage tank 51 by the pump 54, and in the storage tank 51, when the position of the liquid surface of ink becomes equal to or lower than the replenishment start level, ink is replenished from a not-shown main ink tank.

Further, the storage tank 51 is provided with a heater 512 and a temperature sensor (not shown) for heating ink up to a predetermined temperature (e.g., 45° C.) so that the viscosity of ink is reduced to be lower than that in a room temperature. Actually, the head 32 is provided with a driver circuit, and the driver circuit is cooled since ink whose temperature is controlled passes the head 32. This reduces the manufacturing cost of the printer 1, as compared with a case of providing a separate cooling mechanism.

To the supply tank 34, an auxiliary decompressor 37 having a pump, a pressure regulating valve, a pressure gauge and the like is connected, and the auxiliary decompressor 37 reduces a pressure (of gas) inside the supply tank 34 to become a pressure lower than the atmosphere pressure by several mbar (in other words, the pressure inside the supply tank 34 becomes a slightly negative pressure). In a case, for example, where a pressure of ink at each of the nozzles of the head 32 is made lower than the atmosphere pressure by $\alpha$ mbar to form meniscus of ink in the nozzle, when the difference in height in the vertical direction between the preset ink level L1 of ink in the supply tank 34 and the nozzle (the difference is indicated by an arrow D1 in FIG. 3) is $\beta$ centimeter (cm), since the specific gravity of ink used in the printer 1 is almost 1, the inside of the supply tank 34 is decompressed by the auxiliary decompressor 37 so that the pressure in the supply tank 34 may become lower than the atmosphere pressure by $(\beta+\alpha)$ mbar.

In the printer 1, in the state where the inside of the supply tank 34 is thus decompressed, the pressure of ink at the plurality of nozzles of each head 32 becomes negative pressure and menisci of ink are formed in the nozzles to prevent a leak of ink from the nozzles. Further, in the above case where the pressure in the supply tank 34 is lower than the atmosphere pressure by $(\beta+\alpha)$ mbar, by setting the difference in height between the preset ink level L1 of ink in the supply tank 34 and the preset ink level L2 of ink in the storage tank 51 (water head difference indicated by an arrow D2 in FIG. 3) to $(\beta+\alpha)$ cm, it becomes possible to prevent (or suppress) the movement of ink from the supply tank 34 to the storage tank 51 even if the pressure inside the storage tank 51 becomes the atmosphere pressure due to an abnormal condition of the main decompressor 55. Naturally, if the supply line 52 and the return line 53 are provided with emergency block valves for cut off the passages, respectively, in the abnormal condition, such a design as to provide the above water head difference is not needed.

As discussed above, in the ink circulation mechanism 5 of FIG. 3, with the pump 54 driven, ink stored in the storage tank 51 is supplied to the supply tank 34 through the supply line 52, and with the inside of the storage tank 51 decompressed to the negative pressure, the ink is returned from the supply tank 34 to the storage tank 51 through the return line 53. With this operation, the negative pressure inside the storage tank 51 is used to efficiently degas the ink in the storage tank 51 and this prevents a trouble in ejection of ink, such as ejection failure caused by the presence of air bubbles in ink in the heads 32. Further, since the pressure inside the storage tank 51 is kept almost constant, it is possible to keep the amount of ink flowing in the head unit 33 (almost) constant, and this allows appropriate circulation of ink.

Figure 4:
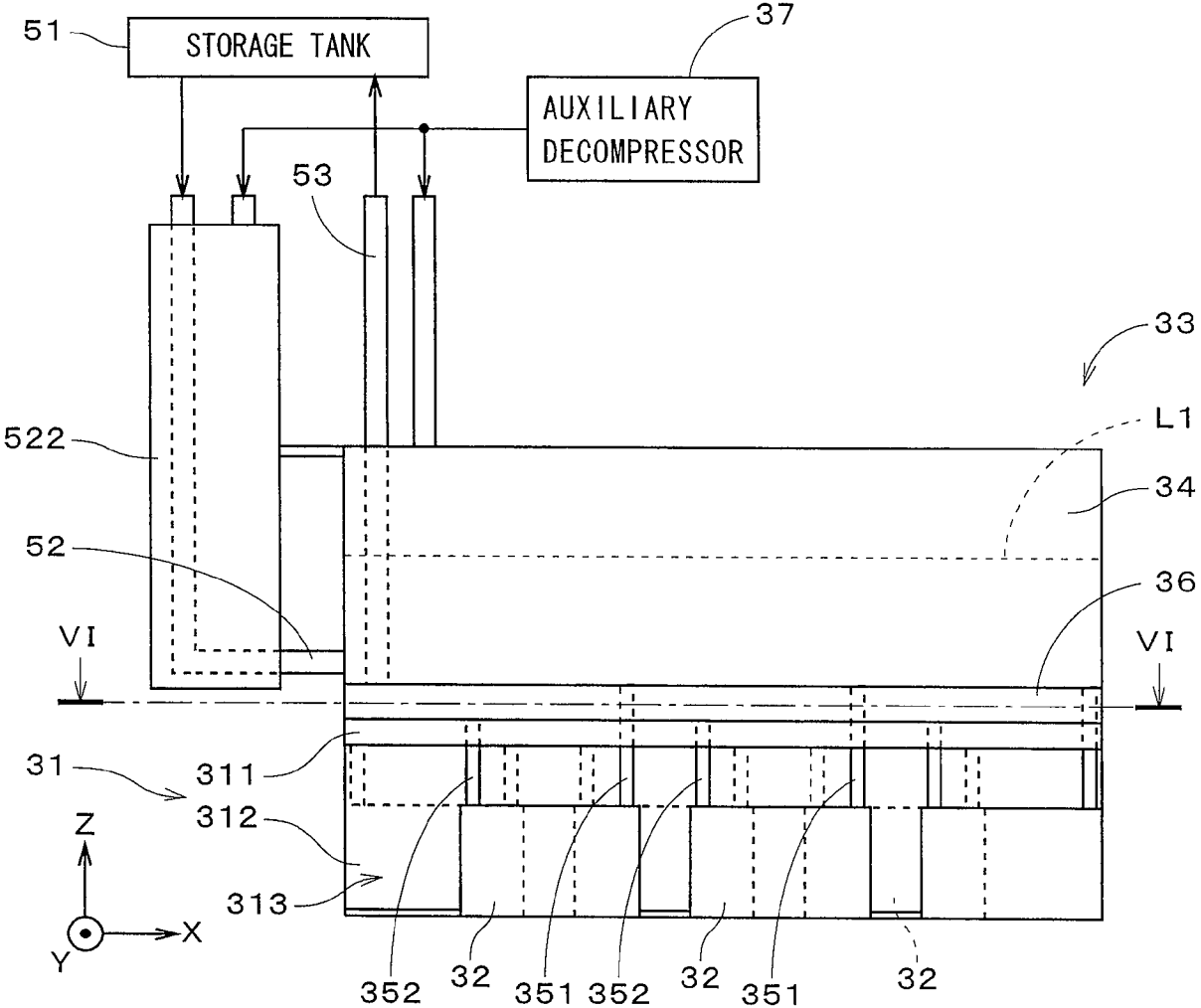
FIG. 4 is an elevational view of a head unit.
Figure 5:
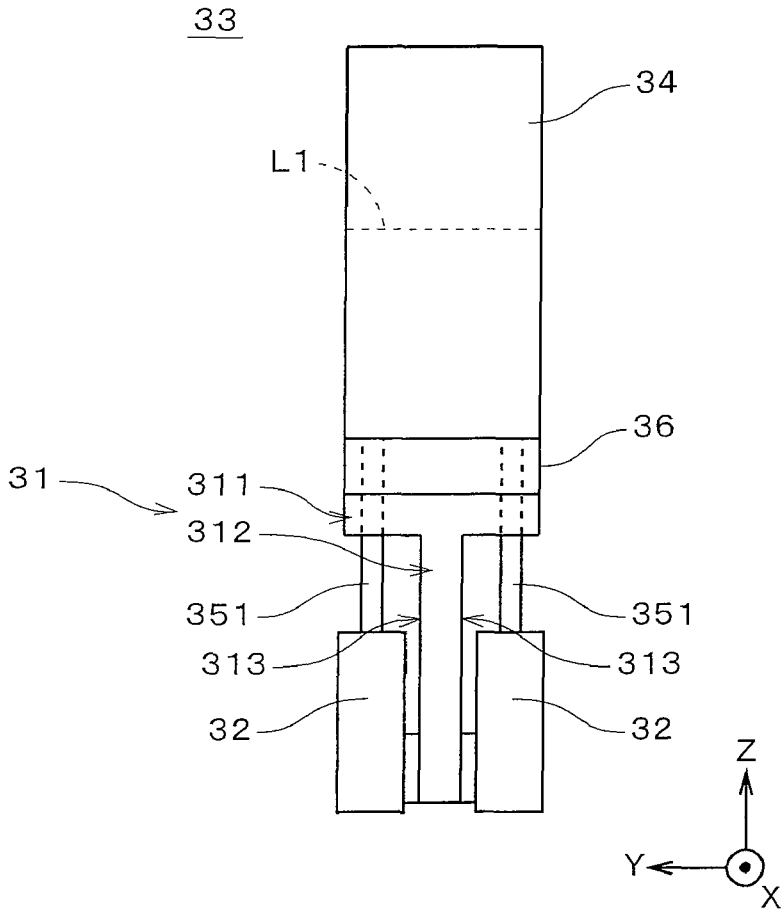
FIG. 5 is a side elevation of the head unit.
Figure 6:
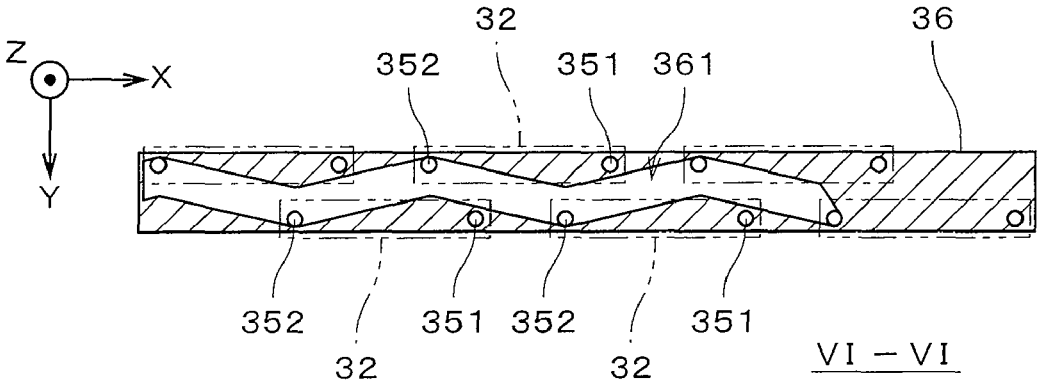
FIG. 6 is a cross section of the head unit.

FIG. 4 is an elevational view of the head unit 33 for one color. FIG. 5 is a side elevation of the head unit 33 viewed from the (+X) side toward the (−X) direction. FIG. 6 is a cross section of the head unit 33, which is taken at a position of line VI-VI of FIG. 4, and in FIG. 6, the plurality of heads 32 are indicated by two-dot chain lines. Though six heads 32 are shown in FIGS. 4 and 6, a lot of heads 32 are provided in an actual head unit 33, as shown in FIG. 2.

As shown in FIGS. 4 and 5, the head unit 33 has a center rib 31 serving as a fixing member to support the plurality of heads 32. The center rib 31 has a T-shaped appearance as viewed along the X direction (see FIG. 5) and has an upper portion 311 having almost the same widths in the X and Y directions as those of the collecting part 36 and the supply tank 34 and a thin plate 312 which is elongated in the X direction and parallel to a vertical direction (Z direction). The upper portion 311 of the center rib 31 is fixed to the collecting part 36 positioned below the supply tank 34, and the plurality of heads 32 are fixed alternately along the X direction on main surfaces 313 of the thin plate 312. This allows the heads 32 arranged in a staggered manner to be firmly fixed while preventing the width of the head unit 33 in the scan direction (Y direction) to become excessively large.

In the head unit 33, as discussed earlier, the supply tank 34 and the collecting part 36 are provided in two tiered structure and the collecting part 36 is positioned between the plurality of heads 32 and the supply tank 34. As shown in FIG. 6, the collecting part 36 has an internal space 361 having an appearance whose horizontal cross section has a shape gently meandering along the X direction in FIG. 6. The appearance of the internal space 361 in the horizontal cross section is almost constant in the vertical direction and the height thereof in the vertical direction is e.g., 10 mm. Further, the minimum width of the internal space 361 in the Y direction is 12 mm and the minimum cross-sectional area thereof in a plane orthogonal to the X direction is 120 $mm^2$. As discussed earlier, ink inside the internal space 361 of the collecting part 36 shown in FIG. 4 is returned to the storage tank 51 through the return line 53 by the ink circulation mechanism 5.

As shown in FIG. 4, the plurality of ink outlet pipes 352 have the same length and the same passage diameter and extend straight downwardly from a bottom surface of the internal space 361 of the collecting part 36 (see FIG. 6), penetrating through the upper portion 311 of the center rib 31, to be connected to the plurality of heads 32, respectively. Each of the ink outlet pipes 352 is formed of a material having high chemical resistance and its diameter is 4 mm and constant (the area of cross section orthogonal to the passage is 12.57 $mm^2$ and constant) in this preferred embodiment. Though a soft material having high chemical resistance is usually expensive, since the head unit 33 can use a straight tube material as the ink outlet pipe 352, a relatively hard and cheap material having high chemical resistance (e.g., black PTFE (polytetrafluoroethylene)) can be used.

The supply tank 34 of FIG. 4 is connected to the auxiliary decompressor 37 for decompression, as discussed earlier, and also connected to the storage tank 51 through the supply line 52. A deaerator 522 is provided in the vicinity of the head unit 33 in the supply line 52, and ink passing through the deaerator 522 is stored into the supply tank 34.

Further, as shown in FIGS. 4 and 5, the plurality of ink inlet pipe 351 have the same length and the same passage diameter and extend straight downwardly from the bottom surface of the internal space of the supply tank 34, penetrating through the collecting part 36 and the upper portion 311 of the center rib 31, to be connected to the plurality of heads 32, respectively. Actually, as shown in FIG. 6, in the horizontal cross section of the collecting part 36, the plurality of ink inlet pipes 351 pass such a portion as not to overlap the area of the internal space 361 and the internal space 361 has such a shape as to avoid interference with the plurality of ink inlet pipes 351. Each of the ink inlet pipes 351 is formed of the same material as that of the ink outlet pipe 352 and has the same diameter as that of the ink outlet pipe 352.

As discussed above, in the head unit 33, an ink inlet part has a plurality of passages leading from the supply tank 34 to the plurality of heads 32, which have the same shape, being straight for extremely low resistance, and an ink outlet part has a plurality of passages leading from the plurality of heads 32 to the collecting part 36, which have the same shape, being straight for extremely low resistance. The area of cross section of the internal space 361 of the collecting part 36, which is orthogonal to a direction in which ink flows, is sufficiently larger than the cross-sectional area of the ink outlet pipe 352 and the difference in passage resistances from ports of the plurality of ink outlet pipes 352 (openings on the side of the internal space 361) to an opening of the return line 53 on the side of the collecting part 36 is negligible. Therefore, in the head unit 33, the passage resistances from the supply tank 34 to the plurality of heads 32 are equal and the passage resistances from the plurality of heads 32 to the return line 53 are almost equal.

Figure 7:
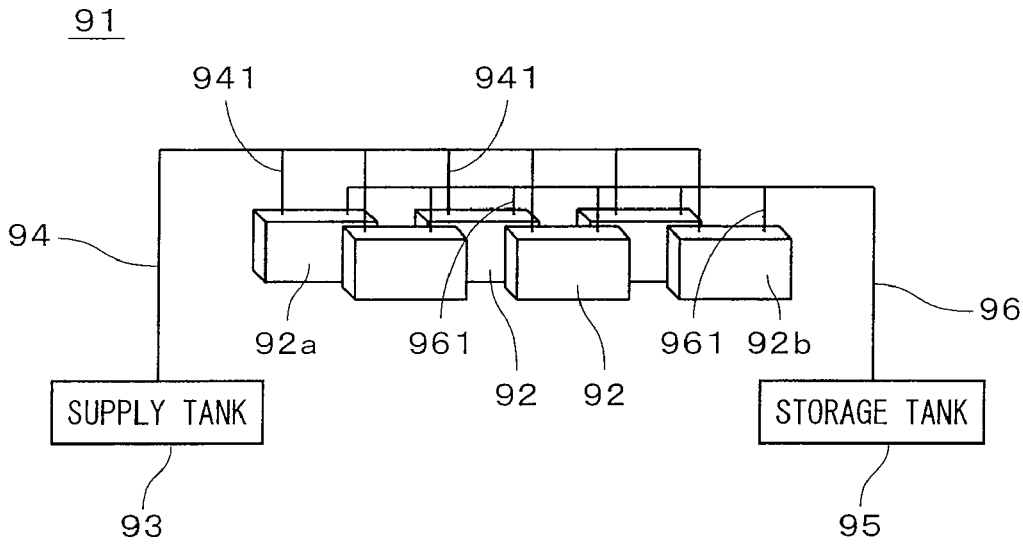
FIG. 7 is a view showing a printer of a comparative example.

FIG. 7 is a view showing a construction of part of a printer 91 of a comparative example. In the printer 91 of the comparative example of FIG. 7, one end of a long ink inlet pipe 94 is connected to a supply tank 93, and a plurality of branch pipes 941 connected to the plurality of heads 92, respectively, are provided in the vicinity of the other end of the ink inlet pipe 94. Further, one end of a long ink outlet pipe 96 is connected to a storage tank 95, and a plurality of branch pipes 961 connected to the plurality of heads 92, respectively, are provided in the vicinity of the other end of the ink outlet pipe 96. In the printer 91 of the comparative example, the resistance of a passage leading from the supply tank 93 to the leftmost head 92*a* in FIG. 7 is smallest and the resistance of a passage leading from the supply tank 93 to the rightmost head 92*b* in FIG. 7 is largest (these passages share part of the ink inlet pipe 94). Further, the resistance of a passage leading from the head 92*a* to the storage tank 95 is largest and the resistance of a passage leading from the head 92*b* to the storage tank 95 is smallest. As a result, there arises a difference in pressures of ink at the nozzles among the plurality of heads 92, and variation (difference) in the landing positions on the base material 9 and the like of ink with respect to the nozzles among the heads 92 becomes remarkable.

In contrast to this, in the head unit 33 of FIG. 4, since the plurality of ink inlet pipes 351 serving as a plurality of passages leading from the supply tank 34 to the plurality of heads 32 have the same shape and the same passage resistance and the plurality of ink outlet pipes 352 serving as a plurality of passages leading from the plurality of heads 32 to the collecting part 36 have the same shape and the same passage resistance, it is possible to equalize the flow rates of ink and the pressures of ink at the nozzles among the plurality of heads 32. As a result, variation (i.e., difference) in the landing positions and the like of ink with respect to the nozzles among the heads 32 is suppressed, and this allows printing of an image with high precision.

Further, in the head unit 33, since the plurality of ink inlet pipe 351 extend straight downwardly from the supply tank 34, with the same length and the same passage diameter, to be connected to the plurality of heads 32, respectively, it is possible to reduce the passage resistance (and the pressure loss) between the supply tank 34 and the plurality of heads 32 to be extremely lower.

In each head 32 used in this preferred embodiment, if variation (in terms of time) in the pressure of ink at the nozzles falls within the range of ±1 mbar, there arises almost no variation in the landing positions and the like of ink with respect to the nozzles. Therefore, if the pressure inside the storage tank 51 varies and the flow rate of ink in the head 32 varies in the range of ±10% with respect to a preset flow rate which is set in advance, in order to suppress the variation in the landing positions and the like of ink with respect to the nozzles in the each head 32, it is necessary to reduce the pressure loss in the preset flow rate of the ink inlet pipe 351 to 10 mbar or less. As discussed above, in the head unit 33, since the passage resistance of the ink inlet pipe 351 between the supply tank 34 and the head 32 is set sufficiently smaller than the passage resistance between the head 32 and the storage tank 51 and the pressure loss in the preset flow rate of the ink inlet pipe 351 is extremely low (10 mbar or less), it is possible to allow the variation in the pressure of ink at the nozzles to fall within the range of ±1 mbar and to thereby suppress the variation in the landing positions and the like of ink with respect to the nozzles.

In the head unit 33, since the internal space 361 of the collecting part 36 positioned between the plurality of heads 32 and the supply tank 34 have such a shape as to avoid interference with the plurality of ink inlet pipes 351 and the plurality of ink outlet pipes 352 extend straight downwardly from the collecting part 36, with the same length and the same passage diameter, to be connected to the plurality of heads 32, respectively, the passage resistance (and the pressure loss) between the plurality of heads 32 and the collecting part 36 can be made extremely lower and thinning of the head unit 33 can be ensured, and it is therefore possible to arrange the head units 33 for a plurality of colors at a narrow interval in the scan direction.

Herein, in the case where the speed of movement of the base material 9 by the feeder 27 (see FIG. 1) slightly varies, where the base material 9 while being moved slightly waves, or the like, if the head units 33 for a plurality of colors are arranged at a wide interval in the scan direction, writing positions of dots corresponding to the plurality of colors are significantly away from one another and the quality of print images is degraded. In contrast to this, in the printer 1, it is possible to arrange the head units 33 for the plurality of colors at a narrow interval in the scan direction and suppress degradation in the quality of print images.

Further, in the head unit 33, since the plurality of heads 32 are fixed along the arrangement direction of the nozzles alternately on the main surfaces 313 of the thin plate 312 which is elongated in the arrangement direction and parallel to the vertical direction, it is possible to prevent the interval between heads 32 in a direction orthogonal to the arrangement direction and the vertical direction (i.e., the direction is the scan direction) to become excessively large and firmly support the plurality of heads 32 arranged in a staggered manner. In the ink (dots) ejected on the base material 9 from the heads 32 fixed on one main surface of the thin plate 312 and the ink ejected on the base material 9 from the heads 32 fixed on the other main surface, this construction reduces the difference of time periods from the landing on the base material 9 to the light emittion by the subsequent light emitting part 38 and it is thereby possible to suppress occurrence of unevenness (mura) in the print image due to the difference of time periods.

Figure 8:
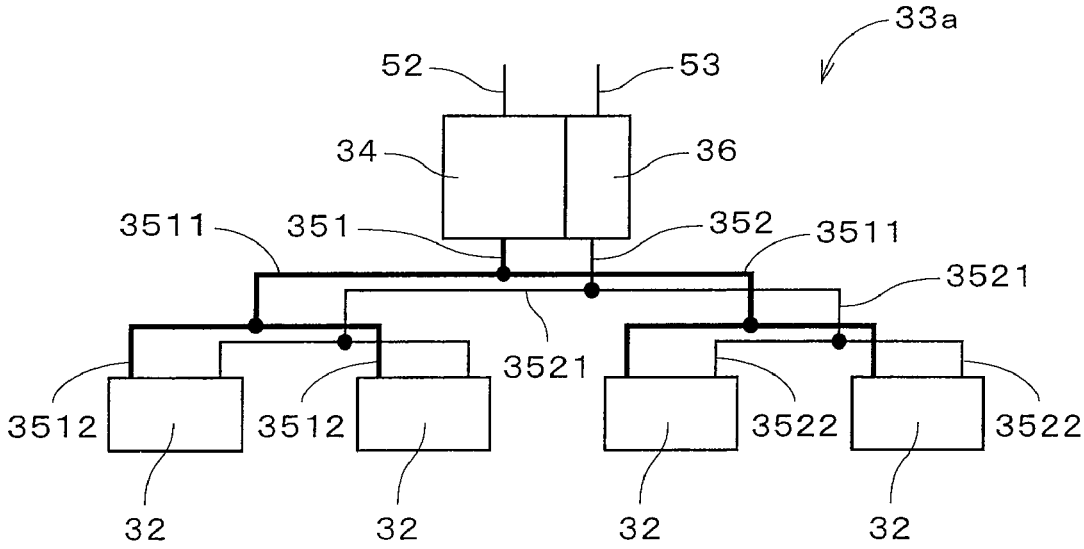
FIG. 8 is a view showing another exemplary head unit.

FIG. 8 is a view showing another exemplary head unit. In the head unit 33*a* of FIG. 8, above the plurality of heads 32, the supply tank 34 and the collecting part 36 are disposed adjacently in a horizontal direction.

To the supply tank 34, one ink inlet pipe 351 extending downwardly is connected, and one side of the ink inlet pipe 351 opposite to the supply tank 34 branches into two first branch pipes 3511 and one side of each first branch pipe 3511 opposite to the ink inlet pipe 351 branches into two second branch pipes 3512. Then, four second branch pipes 3512 are connected to four heads 32, respectively, to construct an ink inlet part for causing ink to flow from the supply tank 34 into the plurality of heads 32. Herein, the two first branch pipes 3511 have the same shape where they have identical length, diameter, bent condition and the like of the whole passage, and the four second branch pipes 3512 also have the same shape. Further, in FIG. 8, the ink inlet pipe 351, the first branch pipes 3511 and the second branch pipes 3512 are represented by thick lines.

In the head unit 33*a* of FIG. 8, an ink outlet part for causing ink to flow out from the plurality of heads 32 to the collecting part 36 have the same structure as the ink inlet part. Specifically, in one ink outlet pipe 352 extending downwardly from the collecting part 36, one side thereof opposite to the collecting part 36 branches into two first branch pipes 3521 and one side of each first branch pipe 3521 opposite to the ink outlet pipe 352 branches into two second branch pipes 3522. Then, the plurality of second branch pipes 3522 are connected to the plurality of heads 32, respectively, to cause ink to flow out from the plurality of heads 32 to the collecting part 36. The two first branch pipes 3521 have the same shape, and the four second branch pipes 3522 also have the same shape.

In the head unit 33*a* of FIG. 8, with the above structure, a plurality of passages leading from the supply tank 34 to the plurality of heads 32 (the ink inlet pipe 351 is shared by all the passages and the first branch pipe 3511 is shared by two passages, and the same applies to the ink outlet part) have the same resistance and a plurality of passages leading from the plurality of heads 32 to the collecting part 36 also have the same resistance, and this makes it possible to almost equalize the flow rates of ink, and the pressures of ink at the nozzles in the plurality of heads 32. As a result, it is possible to suppress variation in the landing positions and the like of ink with respect to the nozzles among the plurality of heads 32.

Thus, in the plurality of heads 32 of the head units 33 and 33*a*, in the viewpoint that the variation in the landing positions and the like of ink with respect to the nozzles is suppressed by equalizing the pressure of ink at the nozzles, it is important that the plurality of passages leading from the supply tank 34 to the plurality of heads 32 in the ink inlet part have the same shape (specifically, have the same shape of cross section orthogonal to the passage for ink at every position of the passage) to thereby equalize the resistances in the plurality of passages and the plurality of passages leading from the plurality of heads 32 to the collecting part 36 in the ink outlet part have the same shape to thereby equalize the resistances in the plurality of passages.

Though the preferred embodiment of the present invention has been discussed above, the present invention is not limited to the above-discussed preferred embodiment, but allows various variations.

In the head unit 33 of FIG. 4, though the collecting part 36 is disposed between the plurality of heads 32 and the supply tank 34, the supply tank 34 may be disposed between the plurality of heads 32 and the collecting part 36. In this case, the internal space of the supply tank 34 has such a shape as to avoid interference with the plurality of ink outlet pipes 352 extending straight downwardly from the collecting part 36 disposed above the supply tank 34. Also in this case, it is possible to ensure thinning of the head unit 33 and arrange the head units 33 for a plurality of colors at a narrow interval in the scan direction.

Further, in the head unit in which the supply tank 34 is disposed between the plurality of heads 32 and the collecting part 36, the center rib 31 for supporting the plurality of heads 32 is provided on the lower surface of the supply tank 34. Thus, since the center rib 31 is provided on one of the supply tank 34 and the collecting part 36 forming two tiered structure, which is disposed below the other, it is possible to ensure thinning of the head unit 33 and firmly support the plurality of heads 32.

Though the head units 33 and 33*a* are especially suitable for the above-discussed ink circulation mechanism 5 in which the pressures in the supply tank 34 and the storage tank 51 are controlled with high precision and variation in the flow rate and the pressure of ink which moves in each head 32 is suppressed, the head units 33 and 33*a* may be used in an ink circulation mechanism in which the main decompressor 55 in the storage tank 51 is not provided and a pump is provided in the return line 53 to return ink from the supply tank 34 to the storage tank 51. In the above case where ink is returned from the supply tank 34 to the storage tank 51 by using the pump, the effect of pulsation of the pump and the like causes variation in the flow rate and the pressure of ink which moves in the head 32, but in the head units 33 and 33*a*, since the variation in the pressures of ink at the nozzles among the heads 32 can be suppressed and it is therefore possible to ensure the quality of print images to some degree.

Figure 9:
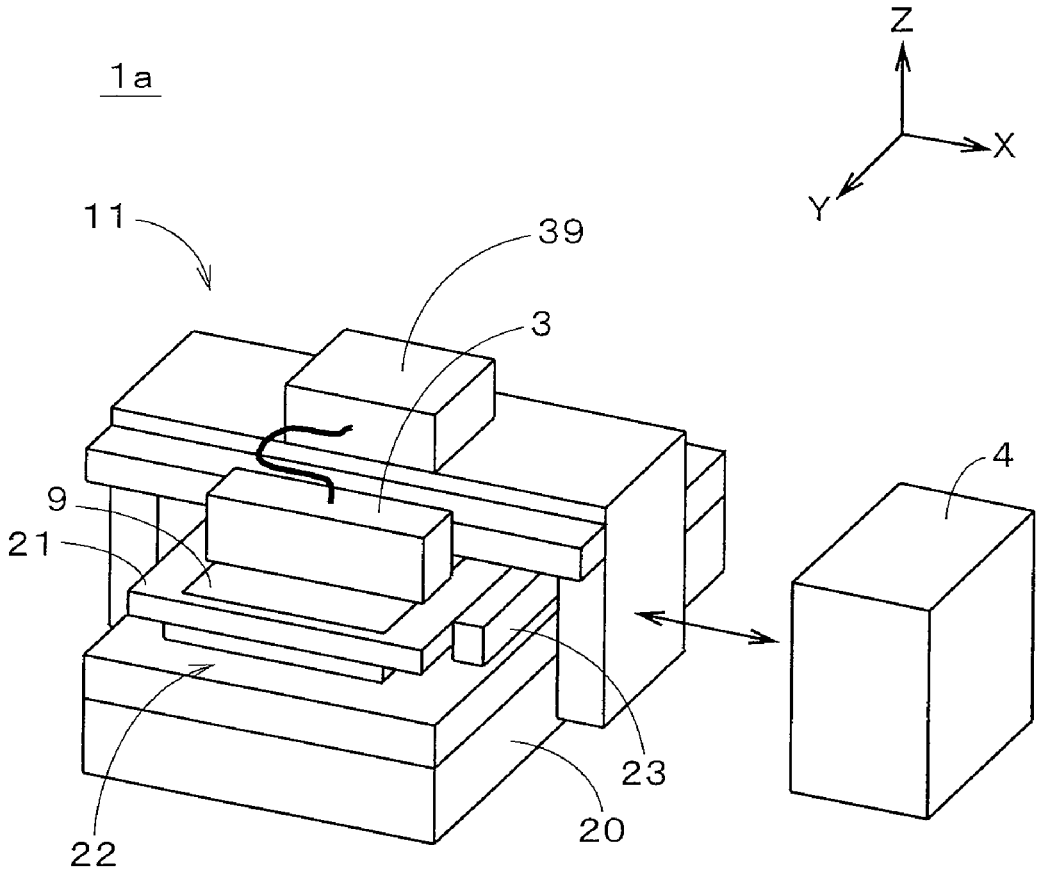
FIG. 9 is a view showing another exemplary printer.

In the printer 1 of FIG. 1 (the so-called roll-to-roll printer), though the base material 9 is moved relatively to the ejection part 3 in the scan direction crossing the arrangement direction of the plurality of nozzles at a constant speed by the feeder 27 for moving the base material 9 in the scan direction, a mechanism for moving the ejection part 3 in the scan direction may be provided in the printer 1. Further, like in a printer 1*a* (flat bed type printer) shown in FIG. 9, a stage 21 for holding the rectangular base material 9 and a stage moving mechanism 22 for moving the stage 21 in the scan direction (the Y direction in FIG. 9) may be provided. Thus, with various constructions, a scan mechanism for moving the base material 9 relatively to the ejection part 3 in the scan direction can be realized. In the printer 1*a* of FIG. 9, the position of the stage 21 relative to the base 20 can be detected by a position detecting module 23 provided on the base 20.

The printing medium used in the printers 1 and 1*a* may be a plate-like member formed of plastic, printing paper and the like, other than the sheet-like base material 9.

While the invention has been shown and described in detail, the foregoing description is in all aspects illustrative and not restrictive. It is therefore understood that numerous modifications and variations can be devised without departing from the scope of the invention.

This application claims priority benefit under 35 U.S.C. Section 119 of Japanese Patent Application No. 2008-137483 filed in the Japan Patent Office on May 27, 2008, the entire disclosure of which is incorporated herein by reference.

What is claimed is:

1. A head unit to which ink is supplied from a storage tank and from which ink thereinside is returned to said storage tank in an inkjet printer, comprising:

a plurality of heads each having a plurality of nozzles arranged in an arrangement direction, for ejecting fine droplets of ink from said plurality of nozzles;

a supply tank storing ink above said plurality of heads;

an ink inlet part for running ink into said plurality of heads from said supply tank, wherein said ink inlet part includes a plurality of ink pipes each having the same length and the same passage diameter and extending straight downwardly from said supply tank to be connected to said plurality of heads;

a collecting part having an internal space into which ink flows from said plurality of heads; and an ink outlet part connecting said plurality of heads and said collecting part, wherein said ink outlet part includes a plurality of ink outlet pipes having the same length and the same passage diameter and extending straight downwardly from said collecting part to be connected to said plurality of heads, wherein said collecting part is positioned between said plurality of heads and said supply tank and has a shape configured to avoid interference with said plurality of ink inlet pipes, or said supply tank is positioned between said plurality of heads and said collection part and has a shape configured to avoid interference with said plurality of ink outlet pipes.

2. The head unit according to claim 1, wherein said supply tank is positioned above said collecting part.

3. The head unit according to claim 1, wherein said plurality of heads are arranged in a staggered manner in said arrangement direction.

4. The head unit according to claim 3, further comprising a fixing member having a thin plate which is elongated in said arrangement direction and parallel to a vertical direction and has main surfaces on both of which said plurality of heads are fixed alternately along said arrangement direction, wherein said fixing member is attached onto one of said supply tank and said collecting part, which is provided under the other.

5. The head unit according to claim 2, wherein said plurality of heads are arranged in a staggered manner in said arrangement direction.

6. The head unit according to claim 5, further comprising a fixing member having a thin plate which is elongated in said arrangement direction and parallel to a vertical direction and has main surfaces on both of which said plurality of heads are fixed alternately along said arrangement direction, wherein said fixing member is attached onto one of said supply tank and said collecting part, which is provided under the other.

* * * * *